United States Patent [19]

Decima

[11] Patent Number: 4,637,472

[45] Date of Patent: Jan. 20, 1987

[54] RAPID DISCHARGE EXTINGUISHER

[75] Inventor: Frédy Decima, Le Plessis Robinson, France

[73] Assignee: ABG Semca, Paris, France

[21] Appl. No.: 741,919

[22] Filed: Jun. 6, 1985

[30] Foreign Application Priority Data

Jun. 8, 1984 [FR] France ..... 84 09034

[51] Int. Cl.[4] ..... A62C 35/08

[52] U.S. Cl. ..... 169/35; 169/28

[58] Field of Search ..... 169/28, 39, 35, 71

[56] References Cited

U.S. PATENT DOCUMENTS

| | | | |
|---|---|---|---|
| 648,371 | 5/1900 | Allen | 169/28 |
| 2,712,881 | 7/1955 | Mathisen | 169/28 X |
| 2,795,282 | 6/1957 | Mathisen | 169/28 X |
| 3,333,641 | 8/1967 | Hansom et al. | 169/28 X |
| 3,884,307 | 5/1975 | Williams . | |

FOREIGN PATENT DOCUMENTS

| | | | |
|---|---|---|---|
| 2620467 | 11/1977 | Fed. Rep. of Germany | 169/28 |
| 2927216 | 8/1981 | Fed. Rep. of Germany | 169/28 |
| 1143458 | 10/1957 | France | 169/28 |
| 274843 | 11/1927 | United Kingdom . | |
| 366704 | 2/1935 | United Kingdom . | |
| 458429 | 12/1936 | United Kingdom . | |
| 643188 | 9/1950 | United Kingdom . | |
| 702919 | 1/1954 | United Kingdom . | |
| 749583 | 5/1956 | United Kingdom . | |
| 749591 | 5/1956 | United Kingdom . | |
| 839255 | 6/1960 | United Kingdom . | |
| 2062457 | 5/1981 | United Kingdom | 169/28 |

*Primary Examiner*—Jeffrey V. Nase
*Assistant Examiner*—L. E. Williams
*Attorney, Agent, or Firm*—Pollock, Vande Sande & Priddy

[57] ABSTRACT

Rapid discharge extinguisher comprising a container containing an inhibition agent, especially a liquid that is vaporized when it is expanded and a pressurized gas such as nitrogen, a through cover sealing the container, and an explosive charge in order to shear the through cover, the explosive charge acting by shock wave and being disposed inside the container, adjacent to the through cover and the discharge time being about 35 milliseconds.

8 Claims, 2 Drawing Figures

RAPID DISCHARGE EXTINGUISHER

The present invention relates to a gas or liquid discharge extinguisher. An extinguisher of this type comprises a container or reservoir containing an inhibitor or protection agent, for example, in liquid form, a body such as that known under the denomination of Freon or Halon, which vaporizes when it expands and a gas, normally nitrogen, under a pressure of some tens of bars. This container is sealed by a through cover or lid that shears upon the explosion of the charge of a detonator. This explosion is generally automatically initiated or triggered once the beginning of a fire has been detected, for example, by means of utilizing an infra-red and/or an ultra-violet detector.

The vaporized Freon or Halon fights the fire through its high inhibitory power, thereby reducing to almost zero the value of certain chemical combustion reactions.

For certain applications, especially those in which the product (for example, an explosive) to be protected is able to be rapidly burned up, it is preferable that the extinguisher acts quickly. In other words, in this case, once the fire has been detected, it is necessary to actuate the detonator as rapidly as possible and to empty the container in the shortest possible time. The present invention allows the reduction of the time lapse between actuating the detonator and completely discharging the container.

With this purpose, the detonator is disposed inside the container in the vicinity of the through cover so that the shock wave created by the explosion is perpendicular to the through cover and acts, in order to evacuate the Freon, in the same direction as the pressurized nitrogen in the container.

In certain extinguishers known up to now (French Pat. No. 1 143 458 or British Pat. No. 2 062 457) an explosive charge is provided inside the container; but this charge acts through increase of pressure and not by the shock wave so that the discharge of the container is less rapid than in the present invention.

In one embodiment of the invention, the explosive charge acting by shock wave is at the end of a cross-piece directed opposite the through cover so that the proportion of the shock wave energy directing opposite the through cover be minimized, and this charge is disposed in a chamber of which it occupies the entire volume prior to the explosion. The charge contains, for example, lead nitrogen.

In a preferred manner, the pyrotechnical rod at the end of which is placed the explosive charge through-crosses the container according to its longitudinal axis.

The outlet neck of the container has advantageously a revolution form developed by the rotation around the longitudinal axis of an arc of a circle the center of which is outside the container. It has been observed that with a neck having this form, the discharge can be carried out more rapidly, the singular pressure drops or singular losses of head being reduced to a strict minimum.

Experiments have proved that an extinguisher according to the invention allows discharge in 35 to 40 milliseconds from the detection of the fire, whereas with known extinguishers this time period is not shorter than about 75 milliseconds.

Furthermore, whereas in the extinguishers of the prior art the nitrogen pressure is about 90 bars, it has been observed that with the invention a pressure of 60 bars is sufficient and that an increase of pressure beyond this value does not diminish substantially the discharge time.

BRIEF DESCRIPTION OF THE DRAWINGS

Other advantages, features and objects of the present invention will become more apparent from reading the following description of certain embodiments, given with reference to the appended drawings in which.

DETAILED DESCRIPTION OF A PREFERRED EMBODIMENT

Figure 1:
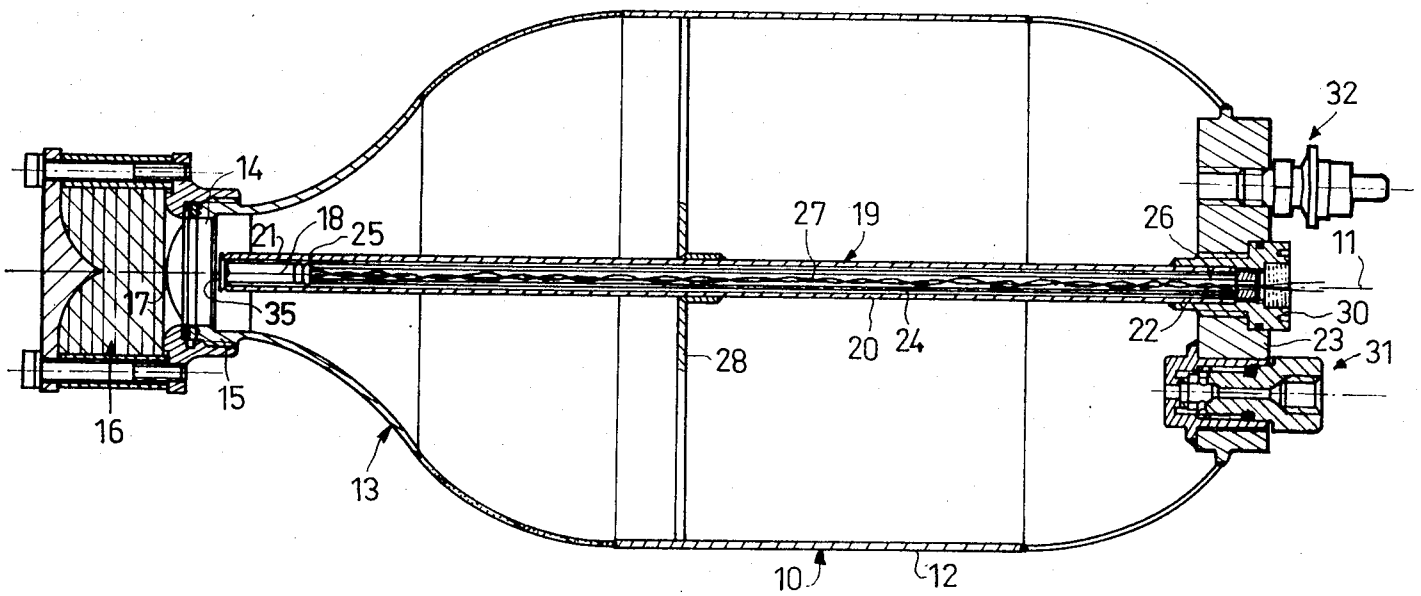
FIG. 1 is a schematic view in axial section of an extinguisher according to the invention.

In the present example, the rapid expansion or discharge type extinguisher is intended to be installed in an area for storing explosive charges. It is associated with a fire detector (not represented) having an infra-red and/or ultra-violet radiation sensor that controls the rapid discharge of the Freon at the beginning of the fire.

The extinguisher comprises a metallic container 10 charged with liquid Freon and nitrogen under a pressure of about 60 bars.

Container 10 has a general revolution form around an axis 11. Its central part 12 is constituted by a cylinder whereas its front part, or mouth 13, has a section that is tapered up to opening 14. In the immediate vicinity of opening 14 container 10 presents another cylindrical section 15 externally threaded in order to receive a spray-cone 16. Immediately to the rear of the cylindrical section 15 the part 13 has, in cross-section through a plane passing through axis 11, a form of an arc of a circle the center of which is disposed outside the container. This latter disposition allows to minimize the singular pressure drops, i.e. to maximize the out-flow rate of the Freon.

Opening 14 is sealed by a through cover 17 constituted by a membrane that shears upon the bursting of an explosive charge 18 which is disposed, according to the invention, inside container 10, adjacent to this through cover 17. In the example, the distance separating through cover 17 from the end of the charge is about 6 mm.

Charge 18 is at the front end of a pyrotechnical rod 19 comprising a long tube 20 of axis 11 the front end 21 of which terminates in the cylindrical part of the container and of which the rear part 22 is integral with the bottom 23.

Tube 20 houses another tube 24 the length of which is equal to the difference between the length of the tube 20 and that of the charge 18. The diameter of this tube 24 is substantially equal to that of the charges 18 so that this latter can be applied against the front end 25 of the tube 24. The end 21 of the tube 20 is sealed by a through cover 35 adjacent to through cover 17. The charge 18, for example, based on lead nitride, is applied against this through cover; furthermore, the external diameter of the charge 18 is slightly smaller than the internal diameter of the tube 24 at its end 21. Therefore, the charge occupied practically completely a chamber defined by through cover 35, a wall at the front end 25 of the tube 24 and by the end 21 of the tube 20.

The rear end 26 of the tube 24 is fixed, like the end 22 of the tube 20, to the bottom 23 of the reservoir 10 or to a piece that is integral with it. Tube 24 contains electrical conductors 27 that connect that charge 18 to an initiating or triggering system associated to the detector outside the container 10.

In order to support rod 19, radial cross-pieces 28 connect, in the front part of the cylindrical zone 12, the external surface of the tube 20 to the internal surface of the container 10.

The bottom 23 presents, furthermore, support means 30 for rod 19 and crossing means for wires 27, on the one hand, a device 31 allowing the filling of the container 10 and constituting a safety- or discharge-valve against over pressures and, on the other hand, a pressostat 32 to detect pressure falls inside the container 10 which is normally disposed with its axis 11 in vertical position, the opening being towards the bottom so that the liquid inhibitor be in evacuation position.

Operating occurs as follows: when the beginning of a fire has been detected, the charge 18 explodes. The shock wave developed by the explosion shears the through cover 17. Due to the nitrogen pressure, the Freon is rapidly evacuated in less time than 40 milliseconds. The expansion provokes the vaporization of this Freon.

The minimization of the time required for the discharge of the Freon is mainly due to the fact that the charge 18 acting by shock wave is inside the container in the vicinity of through cover 17. In fact, the energy of the shock wave is added to the pressure of the nitrogen in order to evacuate the Freon. Furthermore, the shearing of through cover 17 towards the outside of the container does not impair the evacuation. The energy of the shock wave due to the explosion is transmitted and directed towards the through cover 17 since, towards the rear, the charge bears upon the end 25 of the tube 24 that therefore forms on abutment; the recoil phenomenon that would have provoked a loss of energy is therefore eliminated. The small distance between the charge 18 and through cover 17 as well as the fact that this charge 18 occupies almost completely the entire chamber in which it is contained also contributes to a large extent to minimizing the discharge time. Similarly, as already mentioned hereinabove, the section having an arc of a circle form of part 13 of container 10 minimizes the particular losses of head or pressure drops that could hinder the evacuation of the Freon.

Figure 2:
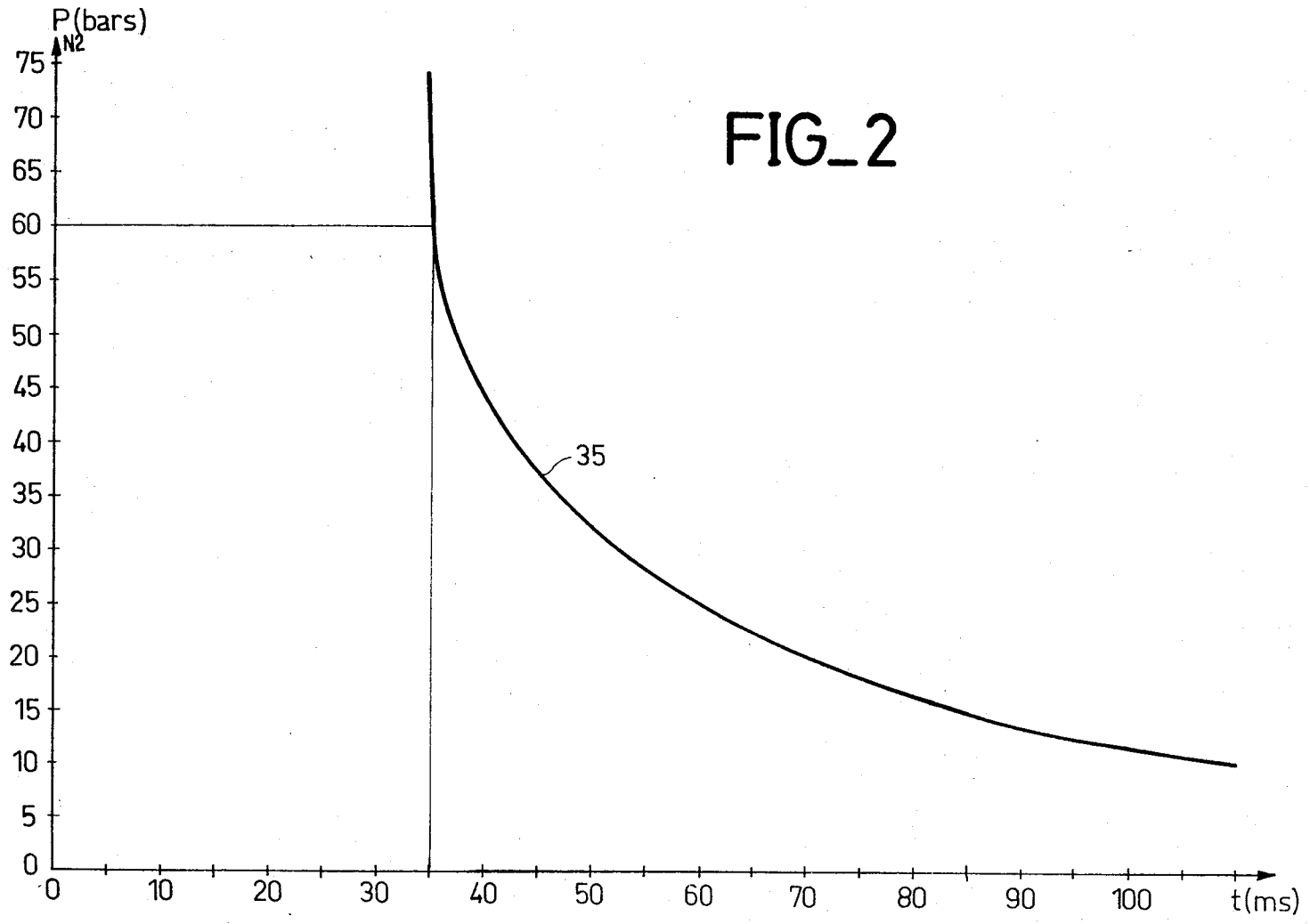
FIG. 2 is a diagram illustrating the properties of the extinguisher according to the invention, as represented in FIG. 1.

The diagram of FIG. 2 represents, in ordinates, the nitrogen pressure P in the container 10 expressed in absolute bars and in abscissae, discharge time t expressed in milliseconds from initiating or triggering charge 18.

Curve 35 shows that for a pressure of 60 bars, discharge time is 35 milliseconds and for higher pressures the time gain is not significant. In other words, it is not indispensable that the nitrogen pressure be very high in order for the discharge time to be small.

I claim:

1. Rapid discharge extinguisher comprising:

a container having a first axis enclosing a liquid inhibitor and a pressurized gas, the liquid inhibitor vaporizing when it expands, the container presenting, a revolution form adjacent to its outlet opening, the resolution form being developed by a rotation about the first axis of an arc of a circle, the center of the circle being located outside the container;

a through cover sealing the container at the outlet opening thereof, the cover being perpendicular to the first axis, no obstacle to the liquid inhibitor being provided near the through cover inside the container; and explosive charge means for developing a shock wave, upon explosion, to shear the through cover, the explosive charge means being disposed inside the container adjacent to the through cover for causing the shock wave developed by the explosive charge means to travel along the first axis, thereby reducing to a minimum singular pressure drops in the container.

2. Extinguisher according to claim 1, wherein the explosive charge means is disposed at the first end of a pyrotechnical rod, the other end of the rod being integral with a rear portion of the container.

3. Extinguisher according to claim 2, wherein the container has substantially a form of revolution for forming a reservoir for the liquid inhibitor; and wherein the pyrotechnical rod is disposed along an axis of the reservoir.

4. Extinguisher according to claim 2, wherein the rear part of the explosive charge means abuts against an abutment in order that the shock wave produced by the explosion is propagated mainly towards the front direction, and wherein the pyrotechnical rod comprises an envelope tube the front end of which houses the explosive charge means, the envelope tube further houses a second tube, the front end of the second tube abutting against the rear part of the explosive charge means.

5. Extinguisher according to claim 2, wherein the pyrotechnical rod comprises an envelope tube having one end integral with the bottom of the container, the envelope tube further being fixed, through radial cross-pieces, to the internal surface of the container.

6. Extinguisher according to claim 1, wherein the explosive charge means is disposed in a chamber located at one end of a pyrotechnical rod.

7. Extinguisher according to claim 1, wherein the rear part of the explosive charge means abuts against an abutment in order that the shock wave produced by the explosion is propagated mainly towards the front direction.

8. Extinguisher according to claim 1, wherein the container is charged under nitrogen pressure of about 60 bars.

* * * * *